US010857581B2

(12) United States Patent
Hilton et al.

(10) Patent No.: US 10,857,581 B2
(45) Date of Patent: Dec. 8, 2020

(54) MACHINE FOR BENDING METAL INCLUDING AN ADJUSTABLE BACKGAUGE

(71) Applicant: Accurpress America Inc., Rapid City, SD (US)

(72) Inventors: Stephen Hilton, Rapid City, SD (US); Allen Guernsey, Rapid City, SD (US)

(73) Assignee: ACCURPRESS AMERICA INC., Rapid City, SD (US)

( * ) Notice: Subject to any disclaimer, the term of this patent is extended or adjusted under 35 U.S.C. 154(b) by 289 days.

(21) Appl. No.: 15/814,158

(22) Filed: Nov. 15, 2017

(65) Prior Publication Data

US 2018/0133771 A1 May 17, 2018

Related U.S. Application Data

(60) Provisional application No. 62/422,588, filed on Nov. 15, 2016.

(51) Int. Cl.
*B21D 5/00* (2006.01)
*B21D 5/04* (2006.01)
*B21D 5/02* (2006.01)

(52) U.S. Cl.
CPC ..... *B21D 5/002* (2013.01); *B21D 5/0281* (2013.01); *B21D 5/04* (2013.01)

(58) Field of Classification Search
CPC ..... B21D 5/0281; B21D 5/002; B21D 5/04
See application file for complete search history.

(56) References Cited

U.S. PATENT DOCUMENTS 2,558,252 A * 6/1951 Ifanger ..... B23B 31/1284 279/33
5,182,936 A * 2/1993 Sartorio ..... B21D 5/0281 72/420
5,526,672 A 6/1996 Cain et al.
6,823,708 B1 * 11/2004 Okubo ..... B21D 5/0281 700/114
9,498,861 B2 * 11/2016 Keller ..... B23C 3/18
2006/0162408 A1 * 7/2006 Niwa ..... B21D 5/02 72/31.1

FOREIGN PATENT DOCUMENTS

EP 1772204 A1 * 4/2007 ..... B21D 5/002

* cited by examiner

*Primary Examiner* — Teresa M Ekiert
(74) *Attorney, Agent, or Firm* — Gordon Rees Scully Mansukhani, LLP

(57) ABSTRACT

A press brake for bending a workpiece that includes a movable ram and a support beam. The press brake includes a backgauge that has an arm with a plurality of fingers for grasping the workpiece. The arm is mounted to an arm support that is mounted on a carriage that is mounted on a backgauge support frame. The arm is configured to swing relative to the arm support in a plane perpendicular to the carriage from a position projecting away from one side of the carriage to a position projecting away from the other side of the carriage. The carriage is configured to rotate 180 degrees so that opposite sides of the workpiece may be positioned under the ram to thereby allow for bending operations to be performed on opposite sides of the workpiece without removing the workpiece from the backgauge.

17 Claims, 5 Drawing Sheets

MACHINE FOR BENDING METAL INCLUDING AN ADJUSTABLE BACKGAUGE

CROSS REFERENCE TO RELATED APPLICATION

The application claims priority to and the benefit of U.S. Provisional Patent Application No. 62/422,588 entitled Method and Machine for Bending Metal and filed Nov. 15, 2016. The foregoing provisional application is incorporated by reference herein in its entirety.

BACKGROUND

The application relates generally to press brakes and, in particular, a press brake that includes a robot arm for the back gage. U.S. Pat. No. 5,526,672 (incorporated by reference herein) includes an exemplary backgauge for a press brake.

A press brake machine or device is used as a tool to make precise bends in metal parts. Generally, a sheet of metal is placed within the machine and positioned precisely using a gauge. A punch, which often has the shape of a "V", is placed against the metal sheet at the point where a bend is required. A punch is pressed into the metal sheet, which in turn is pressed into the die causing the sheet to bend. Frequently, the press brake machine is configured so that die and the punch are long enough to contact the entire length or width of the sheet.

A press brake machine may be configured so that a forming die mounted on a bed may be "U" or "V" shaped. The die may include a pair of dies or half dies, for example. The distance between the dies may be adjusted so that the bearing areas for the metal part or workpiece being formed can be adjusted according to the forming requirements for the workpiece.

BRIEF DESCRIPTION OF THE DRAWINGS

Features, aspects, and advantages of the present invention will become apparent from the following description, appended claims, and the accompanying exemplary embodiments shown in the drawings, which are briefly described below.

DESCRIPTION

Various features of the present invention will be described with reference to the drawings. Like numbers are used throughout the drawings to refer to the same or similar parts and in each of the embodiments of the invention hereafter described.

An exemplary press brake machine may include a ram located above a bed. The machine may include one or more hydraulic cylinders that force the ram (and connected tool) downward toward the bed. Alternatively, the force of hydraulic pressure may be used to force the bed upward.

Figure 1A:
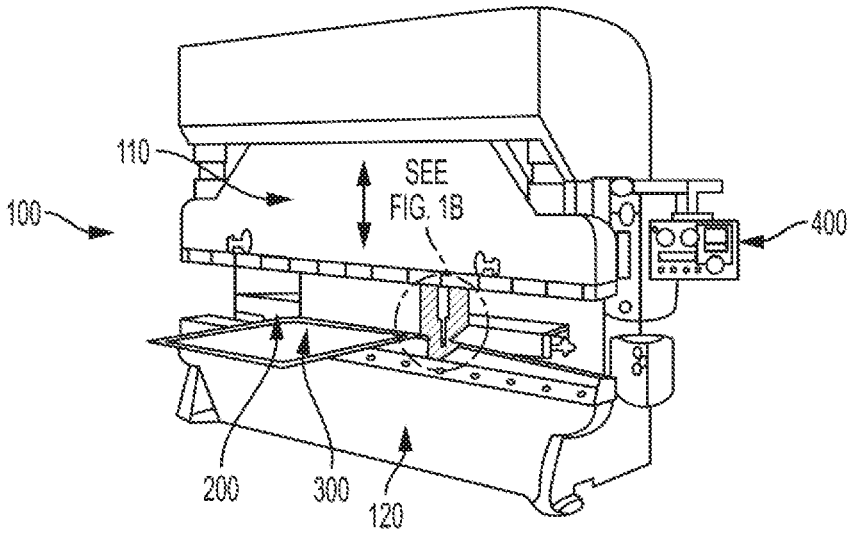
FIG. 1A is a front and right side perspective view of a press brake machine.
Figure 2:
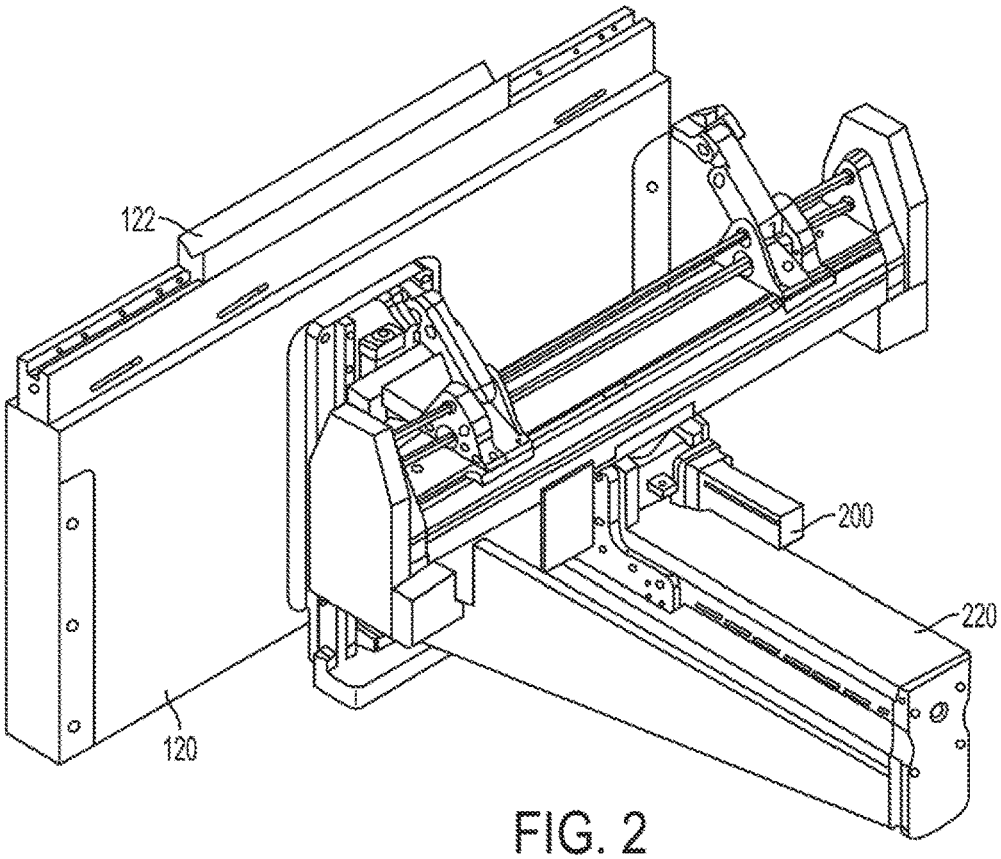
FIG. 2 is a top, rear and left side perspective view of a press brake bed and backgauge.

The press brake disclosed herein is used to bend or otherwise deform sheet-like workpieces, such as sheet metal workpieces. As shown in FIGS. 1A and 2, a press brake 100 has an upper beam or ram 110 and a lower beam or bed 120, at least one of which is movable toward and away from the other. Preferably, the upper beam is movable vertically while the lower beam is fixed in a stationary position. As an example, a male forming punch and a female forming die may be mounted respectively on the upper and lower beams of a press brake.

Figure 1B:
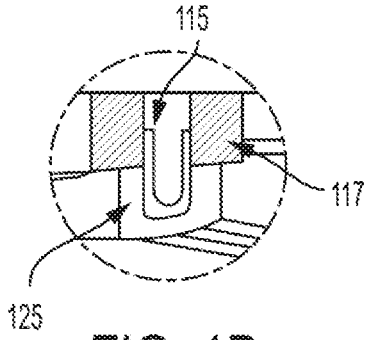
FIG. 1B is a close up view of the area of the press brake machine shown in FIG. 1A encircled and labeled as A.

As shown in the close up view A of FIG. 1B, the punch 115 projects downward into the die 125. The press brake may also include an optional pressure pad 117 for holding the workpiece 300 while the bending operation occurs.

The press brake may include a controller 400 for controlling the bending of the workpiece and/or the movement of the various parts of the press brake, including the backgauge disclosed herein. The controller may be configured to adjust the position along ten or more axis of motion. The use of a controller on the press brake provides for reduced time and improved efficiency of bending operations for even relatively simple bending of parts that include only two or three bends and for lots of parts that only include two or three parts.

The controller may include a display that, for example, provides the user with a graphical representation of the formed part in a simple to use format. The user may input various information such as, for example, the material type, thickness, length and describing the bends and flange lengths. The controller may be configured to set the positions and speeds of all the axis of the machine. Thus, the controller reduces the setup time and operator experience required for bending various parts. In addition, the use of the controller may reduce the amount of scrap material that remains after the bending operation. The majority of controllable axis are found in the backgauge portion of the press brake which may include two or more fingers located at the end of an arm which may grasp a workpiece and act as material stops and supports which allow for accurate gauging (i.e., positioning) of workpieces.

Although some of the metal forming operations may be performed with the same tooling, it is not uncommon for the position of the fingers of the backgauge to be different for each operation. It is advantage to use a movable backgauge for the manufacture of parts which require different backgauge positions. Also, a programmable backgauge enables an operator to perform several operations with the same tooling. The programmable backgauge is programmed to move the fingers of the backgauge to the desired positions for each of the forming operations. Thus, the controller preferably includes software that a user may interface with, via the display or keyboard for example, to control forming operations of the workpiece.

An advantage associated with the use of programmable backgauges is that they greatly increase the number of forming operations that may be performed on a single press brake without having to change the setup. The ability of the fingers to remove the workpiece out of position (or to a new position) between bending operations, eliminates the requirement for the operator to move the workpiece between forming operations. The backgauge may be programmed to move the fingers to the longitudinal position along the bed of the press brake where the operator will perform the next operation on the part. As a result the fingers are accurately and automatically positioned.

Figure 8:
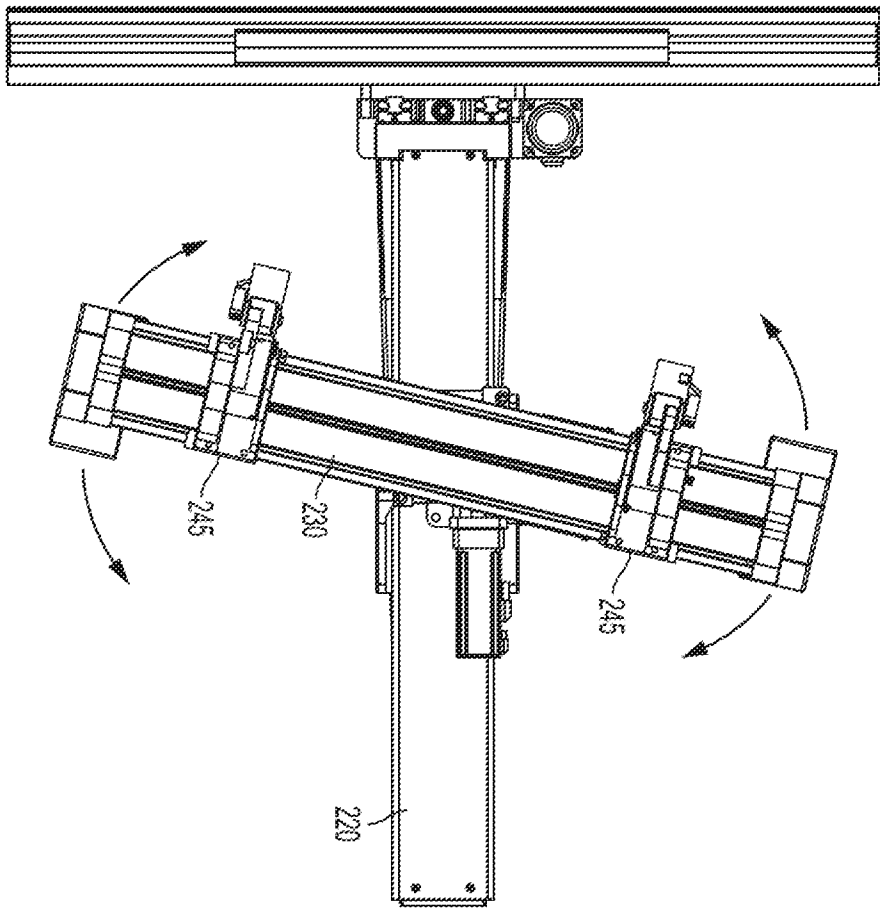
FIG. 8 is top view of the bed and backgauge of FIG. 2 with the arm supporting member of the backgauge rotated out of a parallel position with the bed.

As shown in FIG. 2, the press brake may also incorporate a backgauge 200 which provides an automatically positioned stop to assist in positioning workpieces between the dies of the press brake. Basically, this backgauge comprises a support frame 220 attached to the rear of the press brake on which a carriage 230 is slidably mounted on a rail or rod system 225 for reciprocation toward and away from the press brake bed. The carriage carries a pair of arm supports 245 that are slidably mounted on a rail or rod 235. The carriage 230 is automatically positioned at preset distances from the press brake bed by means of a motor or other suitable mechanism. As shown in FIG. 8, the carriage 230 is also configured to pivot relative to the support frame 220. Thus, the position of the carriage may be adjusted both by pivoting or rotation and linearly by sliding along the support frame 220. A rotating gear box may be provided for adjusting the angle of the carriage. The position of the carriage 230 is controller by the controller 400 in a manner similar to control of the press break.

Figure 3:
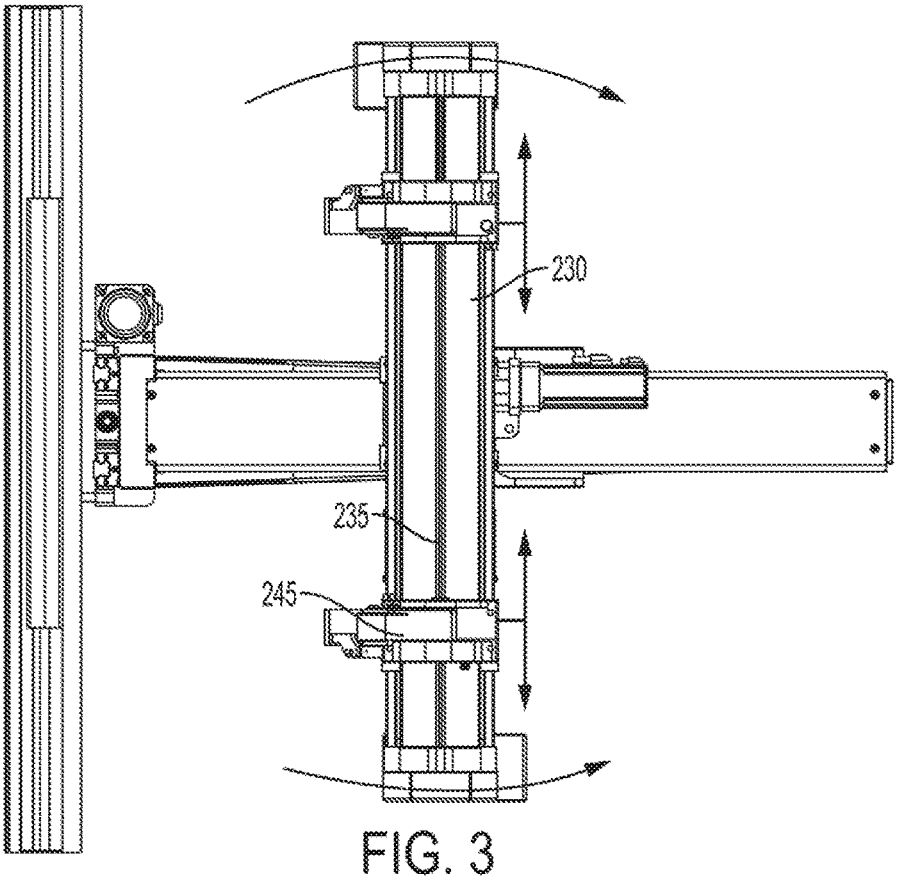
FIG. 3 is a top view of the bed and backgauge of FIG. 2.

As shown in FIG. 3, the position of the arm supports 245 along the carriage 230 may be separately controlled. Thus, the arm supports 245 along the length of a workpiece 300 so that the arms 242 and the associated fingers 244 can be placed in the appropriate position for properly grasping the workpiece in position during any forming operation. Thus, the fingers 244 may pivot relative to the arms 242, which in turn are movable relative to the arm supports 245. The fingers 244 also may include claws that open and close to grasp the workpiece. The position of the arm supports 245, carriage 230, arms 242, fingers 244 and support frame may all be controlled by the controller 400, which may issue control commands to various motors for driving the components to new positions.

Figure 4:
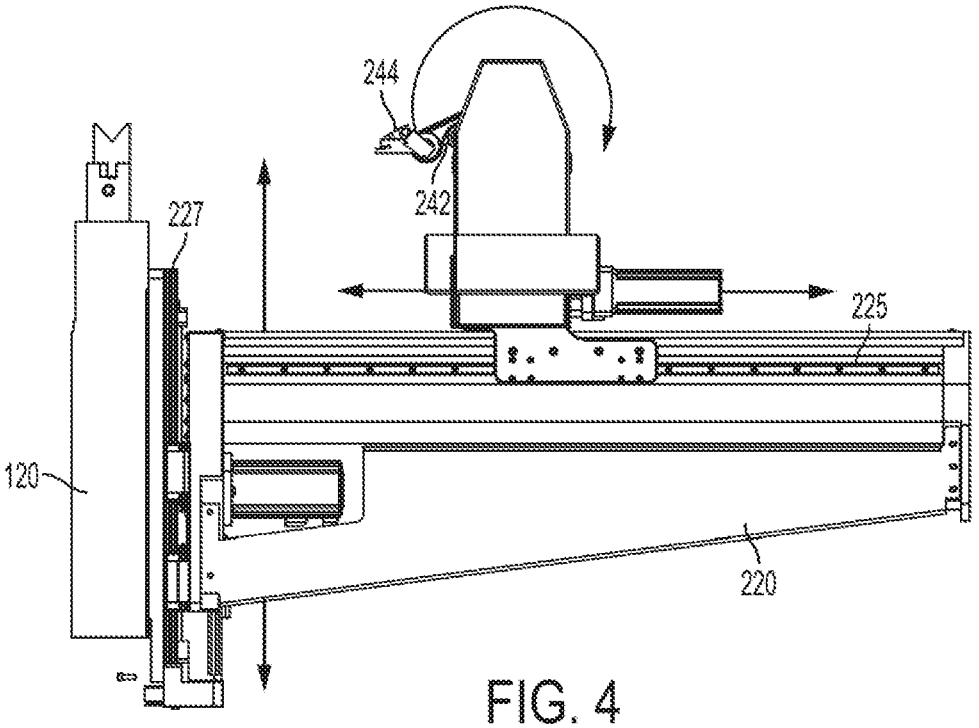
FIG. 4 is left side view of the bed and backgauge of FIG. 2 with the workpiece supporting arm in the forward position.
Figure 5:
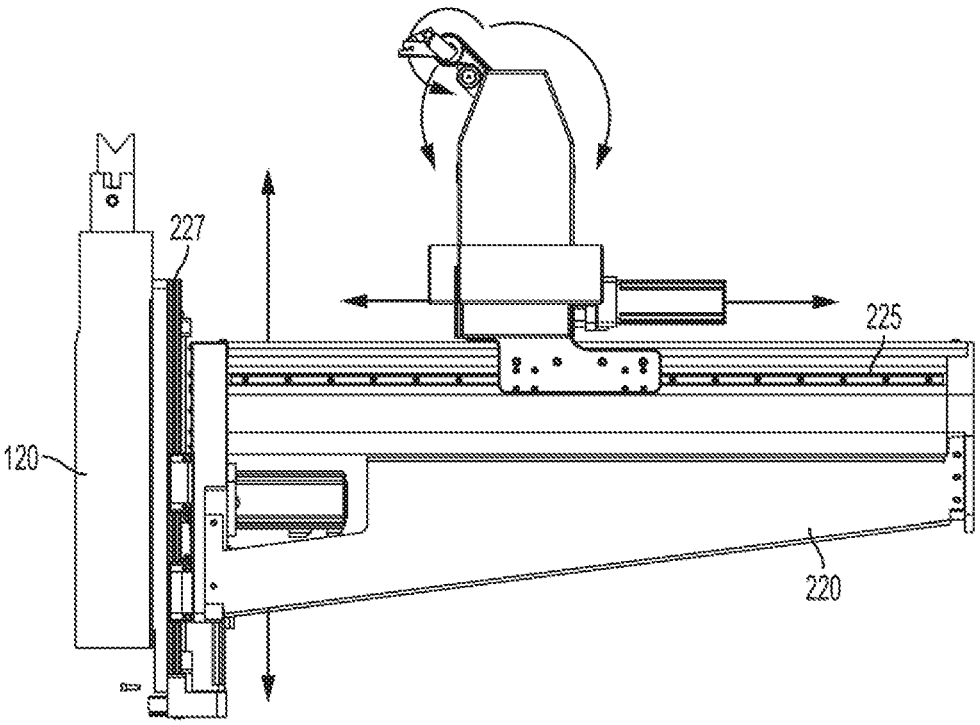
FIG. 5 is left side view of the bed and backgauge of FIG. 2 with the workpiece supporting arm in a front and upward position.
Figure 6:
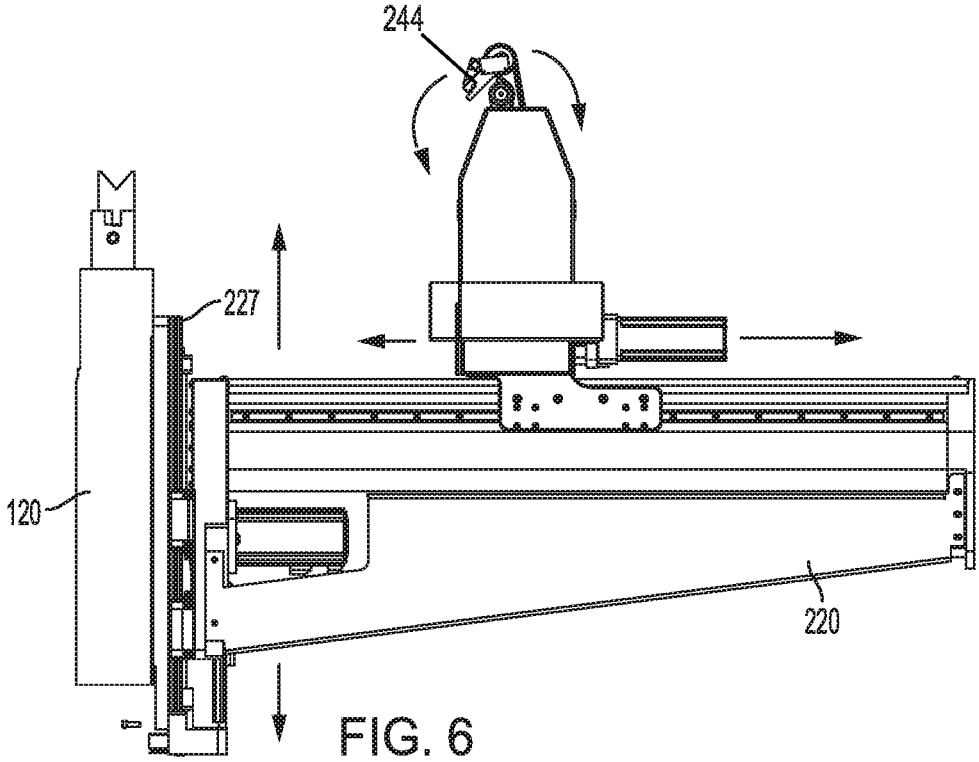
FIG. 6 is left side view of the bed and backgauge of FIG. 2 with the workpiece supporting arm in a top position.
Figure 7:
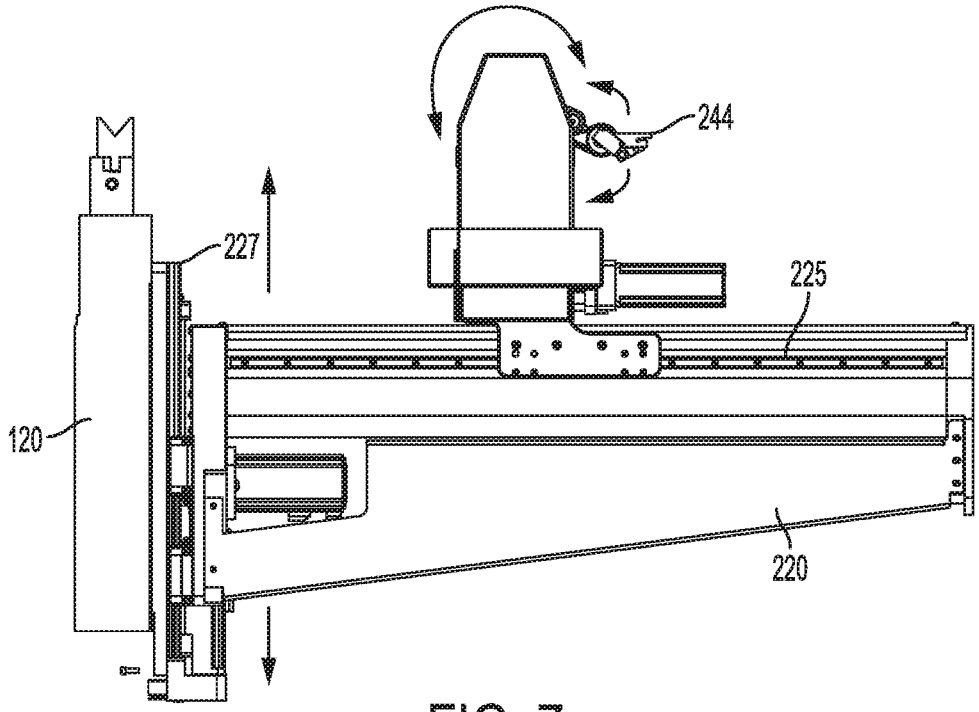
FIG. 7 is left side view of the bed and backgauge of FIG. 2 with the workpiece supporting arm in a rearward position.

As shown in FIGS. 4-7, the position of the support frame may be changed vertically. The support frame is movably attached to the bed and may slide up and down a supporting track 227. FIG. 4 shows the fingers 244 positioned in the forward position. The fingers 244 could be positioned forward and hold the workpiece 300 in position while a bending or other forming operation is performed. The fingers 244 may be repositioned so that the workpiece 300 may be removed from position under the ram. For example, the arms 242 and fingers 244 may be moved to the rearward facing position shown in FIG. 7. In moving from the forward position shown in FIG. 4 to the rearward position shown in FIG. 7, the workpiece may be turned over so that an opposite side is facing upward. Then, if desired the carriage may be rotated approximately 180 degrees (see FIG. 8, for example) and the workpiece positioned under the ram so that a bending or forming operation may be formed on the opposite side of the workpiece.

Thus, as described above, the backgauge system 200 disclosed herein allows for bends to be formed on opposite sides of a sheet of metal without the operator having to remove the workpiece or sheet from the press brake machine. The disclosed system also provides for movement of the workpiece according to various different axes (see FIGS. 2-8) in order to position the workpiece properly for bending.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to any precise numerical ranges provided. Accordingly, these terms should be interpreted as indicating that insubstantial or inconsequential modifications or alterations of the subject matter described are considered to be within the scope of the invention.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," "fore," "aft," "inboard," "outboard," etc.) are merely used to describe the orientation of various elements in the figures. It should be noted that the orientation of various elements may differ according to other exemplary embodiments, and that such variations are intended to be encompassed by the present disclosure.

It is important to note that the construction and arrangement of the press brake shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A press brake for bending a workpiece comprising:

a movable ram and a support beam, wherein the ram and the support beam are connected to a supporting frame;

wherein the ram and the support beam are separated by a gap and wherein the press brake is configured to receive the workpiece in the gap; and wherein the ram is configured to be driven to thereby close the gap and force a tool connected to the rain to contact the workpiece and cause the workpiece to bend; and a backgauge including an arm with a plurality of fingers for grasping the workpiece; wherein the arm is mounted to an arm support that is mounted on a carriage and wherein the carriage is mounted on a backgauge support frame that is movable connected to the supporting frame;

a backgauge controller configured to control the movement of the backgauge;

wherein the arm is configured to swing relative to the arm support in a plane perpendicular to the carriage from a position projecting away from one side of the carriage to a position projecting away from the other side of the carriage and wherein the carriage is configured to rotate 180 degrees so that opposite sides of the workpiece may be positioned under the ram to thereby allow for bending operations to be performed on opposite sides of the workpiece without removing the workpiece from the backgauge.

2. The press brake of claim 1, wherein the fingers are configured to pivot relative to the arm.

3. The press brake of claim 1, wherein the backgauge support frame is configured to move vertically.

4. The press brake of claim 1, wherein the carriage is configured to slide horizontally so that the arm support can be positioned closer or further from the support beam.

5. The press brake of claim 1, further comprising a second arm with a plurality of fingers for grasping the workpiece; wherein the second arm is mounted to a second arm support that is mounted on the carriage.

6. The press brake of claim 5, wherein each of the arm supports is movable relative to the carriage so that the distance between the arm supports can be varied.

7. The press brake of claim 6, wherein each of the fingers are configured to pivot relative to each of the arms.

8. The press brake of claim 7, wherein the backgauge support frame is configured to move vertically.

9. The press brake of claim 8, wherein the carriage is configured to slide horizontally so that the arm supports can be positioned closer or further from the support beam.

10. A press brake backgauge comprising:

a pair of arm supports mounted on a carriage, wherein the carriage is mounted on a backgauge support frame;

wherein an arm with a plurality of fingers for grasping a workpiece is connected to each of the arm supports;

wherein each of the arms is configured to swing relative to the arm support in a plane perpendicular to the carriage from a position projecting away from one side of the carriage to a position projecting away from the other side of the carriage and wherein the carriage is configured to rotate 180 degrees so that opposite sides of the workpiece may be positioned to be worked on by a press brake to thereby allow for bending operations to be performed on opposite sides of the workpiece without removing the workpiece from the backgauge; and wherein the carriage is configured to slide horizontally along the support frame so that the arm supports can be positioned closer or further from a support beam of the press brake.

11. The backgauge of claim 10, wherein each of the arm supports is movable relative to the carriage so that the distance between the arm supports can be varied.

12. The backgauge of claim 11, wherein each of the plurality fingers are configured to pivot relative to each of the arms.

13. The backgauge of claim 12, wherein the backgauge support frame is configured to move vertically.

14. A press brake for bending a workpiece comprising:

a movable ram and a support beam, wherein the ram and the support beam are connected to a supporting frame;

wherein the ram and the support beam are separated by a gap and wherein the press brake is configured to receive the workpiece in the gap; and wherein the ram is configured to be driven to thereby close the gap and force a tool connected to the ram to contact the workpiece and cause the workpiece to bend; and a backgauge including an arm with a plurality of fingers for grasping the workpiece; wherein the arm is mounted to an arm support that is mounted on a carriage and wherein the carriage is mounted on a backgauge support frame;

a backgauge controller configured to control the movement of the backgauge;

wherein the arm is configured to swing relative to the arm support in a plane perpendicular to the carriage from a position projecting away from one side of the carriage to a position projecting away from the other side of the carriage; and wherein the carriage is configured to rotate 180 degrees relative to the backgauge support frame.

15. The press brake of claim 14, wherein the plurality of fingers are configured to rotate relative to the arm.

16. The press brake of claim 15, wherein the carriage is configured to slide horizontally along the support frame so that the arm supports can be positioned closer or further from the support beam.

17. The press brake of claim 16, wherein the support frame is configured to move vertically relative to the supporting frame.

* * * * *